US009091106B2

(12) United States Patent
Allen et al.

(10) Patent No.: US 9,091,106 B2
(45) Date of Patent: Jul. 28, 2015

(54) PANEL HARDWARE SYSTEM AND ASSOCIATED METHODS

(71) Applicants: Kathryn J. Allen, Provo, UT (US); Paul J. Allen, Provo, UT (US)

(72) Inventors: Kathryn J. Allen, Provo, UT (US); Paul J. Allen, Provo, UT (US)

( * ) Notice: Subject to any disclaimer, the term of this patent is extended or adjusted under 35 U.S.C. 154(b) by 39 days.

(21) Appl. No.: 13/790,462

(22) Filed: Mar. 8, 2013

(65) Prior Publication Data

US 2014/0250633 A1 Sep. 11, 2014

(51) Int. Cl.
*E05D 15/06* (2006.01)
*A47H 15/00* (2006.01)

(52) U.S. Cl.
CPC ..... *E05D 15/0652* (2013.01); *E05D 15/063* (2013.01); *E05Y 2600/10* (2013.01); *E05Y 2600/634* (2013.01); *Y10T 16/379* (2015.01); *Y10T 29/4984* (2015.01)

(58) Field of Classification Search
USPC ..... 16/91, 93 R, 90, 94 R, 96 R, 102, 87 R, 16/97; 312/330.1, 334.5, 334.6, 334.36; 49/404, 409, 410, 420, 380, 413, 421; 160/330, 346
See application file for complete search history.

(56) References Cited

U.S. PATENT DOCUMENTS

| | | | | |
|---|---|---|---|---|
| 3,242,535 | A | 3/1966 | Ferris | |
| 3,636,588 | A | 1/1972 | Ferris | |
| 3,874,748 | A * | 4/1975 | Figueroa | 384/19 |
| 4,905,345 | A * | 3/1990 | Lunenschloss et al. | 16/94 R |
| 5,069,512 | A * | 12/1991 | Sykes | 312/139.2 |
| 5,302,030 | A * | 4/1994 | Buie et al. | 384/18 |
| 5,694,719 | A * | 12/1997 | Bejune et al. | 49/502 |
| 6,497,072 | B2 * | 12/2002 | Fries | 49/209 |
| 6,826,878 | B1 * | 12/2004 | Rovtar | 52/213 |
| 7,065,831 | B2 * | 6/2006 | Elmer | 16/91 |
| 7,246,411 | B2 * | 7/2007 | Campbell et al. | 16/2.4 |
| 7,637,059 | B2 * | 12/2009 | Chang et al. | 49/425 |
| 7,841,048 | B2 * | 11/2010 | Tsai | 16/91 |
| 2004/0098831 | A1 * | 5/2004 | Elmer | 16/89 |
| 2008/0203261 | A1 | 8/2008 | Meyer | |

* cited by examiner

*Primary Examiner* — Chuck Mah

(57) ABSTRACT

The present disclosure is drawn to a panel hardware system and related methods. The panel hardware system can comprise a track and a wheel configured to interface with the track. The panel hardware system can also comprise a hanger including an extension portion, and a panel coupling portion to couple with a panel, wherein the track or the wheel is coupleable to a support structure and the other of the track or the wheel is coupleable to the extension portion such that the panel is movable relative to the support structure. In addition, the panel hardware system can comprise an adjustable spacer operable with the track, the wheel, and/or the hanger to provide a distance between the panel and the support structure as the panel moves relative to the support structure. The spacer can facilitate variable spacing configurations to accommodate a variety of panel dimensions or support structure configurations.

44 Claims, 11 Drawing Sheets

PANEL HARDWARE SYSTEM AND ASSOCIATED METHODS

BACKGROUND

Panels, such as doors, windows, signage, shutters, chalkboards, partitions, etc., are available in a wide variety of configurations and are often movable. In particular, one type of door, known as a "barn door," is typically slidable along a track or rail to block or allow access through a doorway. Special hardware exists for barn doors to facilitate the sliding of the door relative to the doorway. Because of differences in door dimensions, such as width and thickness, and wall features, such as stud locations and door trim or borders, barn door installation is typically a customized process to suit a particular door and wall configuration.

DETAILED DESCRIPTION

Figure 1A:
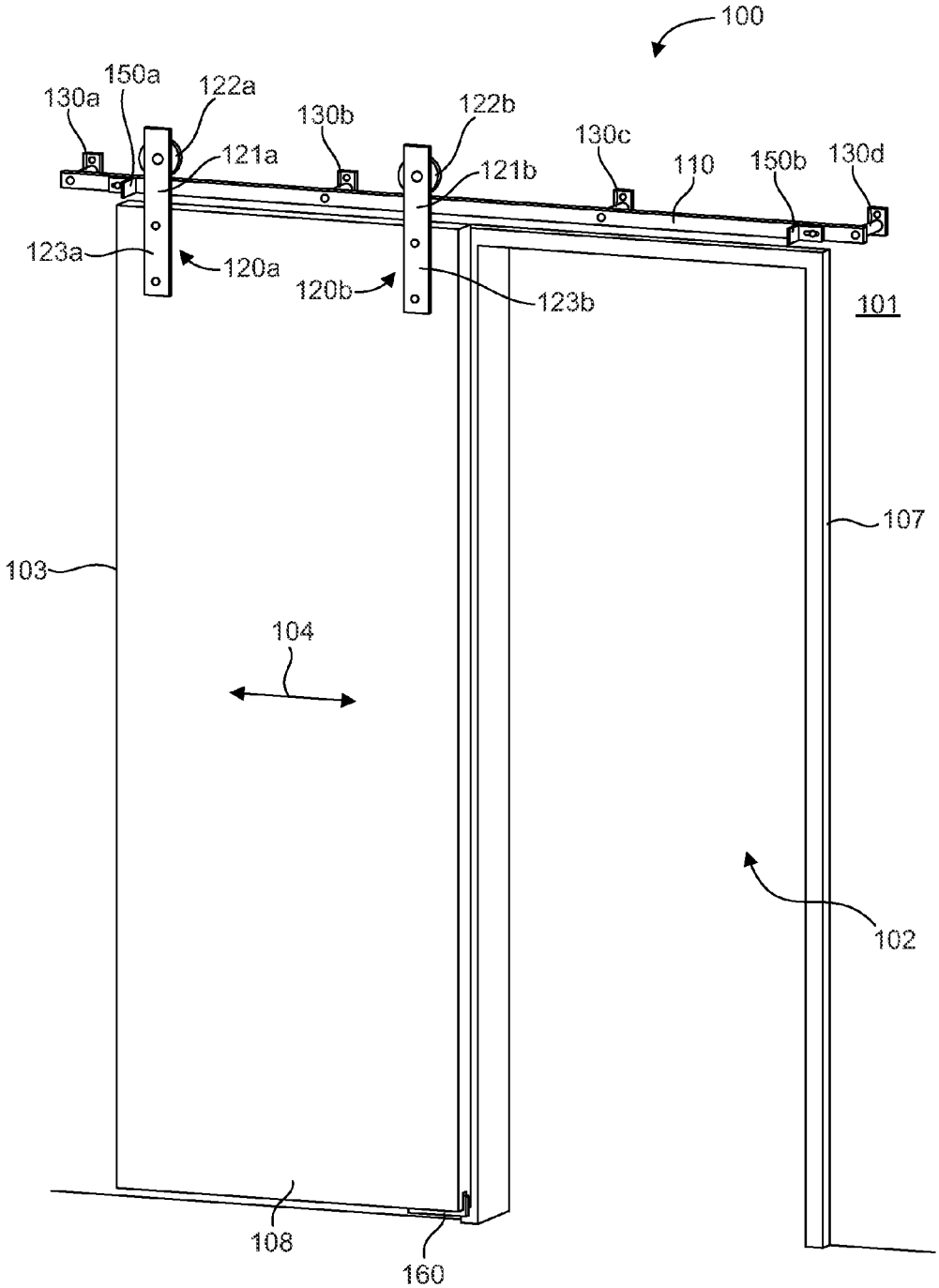
FIG. 1A is a perspective view of a panel hardware system, in accordance with an embodiment of the present disclosure.

Reference will now be made to the exemplary embodiments, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. It is also to be understood that the terminology used herein is used for the purpose of describing particular embodiments only. The terms are not intended to be limiting unless specified as such.

It must be noted that, as used in this specification and the appended claims, the singular forms "a," "an," and "the" include plural referents unless the content clearly dictates otherwise.

In describing embodiments of the present invention, reference will be made to "first" or "second" as they relate to spacer threaded portions, for example. It is noted that these are merely relative terms, and a spacer threaded portion described or shown as a "first" threaded portion could just as easily be referred to a "second" threaded portion, and such description is implicitly included herein.

Dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of about 1 wt % and about 20 wt %, but also to include individual weights such as 2 wt %, 11 wt %, 14 wt %, and sub-ranges such as 10 wt % to 20 wt %, 5 wt % to 15 wt %, etc.

In accordance with these definitions and embodiments of the present disclosure, a discussion of the various systems and methods is provided including details associated therewith. This being said, it should be noted that various embodiments will be discussed as they relate to the systems and methods. Regardless of the context of the specific details as they are discussed for any one of these embodiments, it is understood that such discussion relates to all other embodiments as well.

The present disclosure is drawn to a panel hardware system that can be utilized by a variety of different panel types, such as doors, windows, signage, shutters, chalkboards, partitions, etc. in which movement relative to a support surface is desired. The panel hardware system can accommodate a variety of panel dimensions, such as width and thickness, and wall features, such as stud locations and trim or borders. The panel hardware system can comprise a track and a wheel configured to interface with the track. The panel hardware system can also comprise a hanger including an extension portion, and a panel coupling portion to couple with a panel, wherein the track or the wheel is coupleable to a support structure and the other of the track or the wheel is coupleable to the extension portion such that the panel is movable relative to the support structure. Additionally, the panel hardware system can comprise an adjustable spacer operable with the track, the wheel, and/or the hanger to provide a distance between the panel and the support structure as the panel moves relative to the support structure. The spacer can facilitate variable spacing configurations to accommodate a variety of panel dimensions or support structure configurations.

In one aspect, the disclosure provides a method for facilitating installation of a panel. The method can comprise providing a track. The method can also comprise providing a wheel configured to interface with the track. The method can further comprise providing a hanger including an extension portion, and a panel coupling portion to couple with a panel, wherein the track or the wheel is coupleable to a support structure and the other of the track or the wheel is coupleable to the extension portion such that the panel is movable relative to the support structure. The method can further comprise providing an adjustable spacer operable with at least one of the track, the wheel, and the panel hanger to provide a distance between the panel and the support structure as the panel moves relative to the support structure. Additionally, the method can comprise facilitating variable spacing configurations of the spacer to accommodate a variety of panel dimensions or support structure configurations.

In another aspect, the disclosure provides a method of hanging a panel. The method can comprise obtaining i) a track; ii) a wheel configured to interface with the track; iii) a hanger including an extension portion, and a panel coupling portion to couple with a panel, wherein the track or the wheel is coupleable to a support structure and the other of the track or the wheel is coupleable to the extension portion such that the panel is movable relative to the support structure; and iv) an adjustable spacer operable with at least one of the track, the wheel, and the door hanger to provide a distance between the panel and the support structure as the panel moves relative to the support structure. The method can also comprise attaching a panel to the hanger. The method can further comprise affixing the track or the wheel to the support structure with the spacer positioned therebetween. Additionally, the method can comprise adjusting the spacer to provide a distance between the support structure and the panel so that the panel can freely move along the support structure when the wheel moves relative to the track.

Figure 1B:
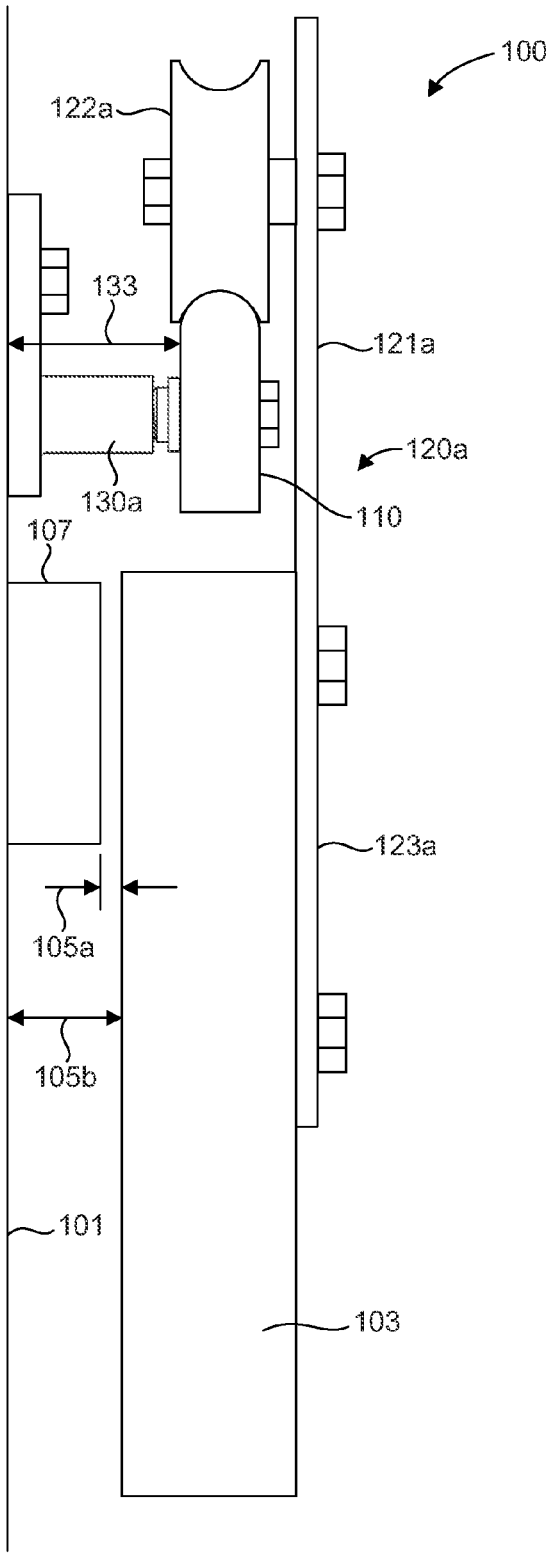
FIG. 1B is a close-up side view of the panel hardware system of FIG. 1A.

FIGS. 1A and 1B show an embodiment of a panel hardware system 100, in accordance with the present disclosure. As used herein, a "panel" can include a door, a window, a sign, a shutter, a chalkboard, a partition, or any other type of panel. In some embodiments illustrated and discussed herein, a panel is depicted as a door 103. Although a door may be illustrated and referred to generally herein, it should be recognized that the descriptions and embodiments of the present disclosure can be applied to any panel system.

The hardware system 100 can include a track 110 and a wheel 122*a*, 122*b* configured to interface with the track. As shown in the figures, the track is coupleable to a support structure, such as a wall 101, above a doorway 102. The track can be oriented substantially horizontal and can provide a support structure for the door 103. The hardware system can also include a hanger 120*a*, 120*b* to couple with the door and to interface with the track. Thus, the hanger can include a door coupling portion 123*a*, 123*b* to couple with the door 103 and an extension portion 121*a*, 121*b* coupled to a wheel 122*a*, 122*b* that can be configured to interface with and roll along the track. The door can therefore be movable in direction 104 relative to the doorway. Although the hanger is illustrated as having a side-mount configuration sized for a door, it should be recognized that a hanger can be of any suitable size or configuration, such as a top mount configuration for mounting to a top of a door or other panel.

The hardware system 100 can also include an adjustable spacer 130*a*, 130*b*, 130*c*, 130*d* operable with the track 110 to provide a distance between the door 103 and the wall 101 as the door moves relative to the doorway 102. In one aspect, a length 133 of the spacer can be adjustable to vary spacing configurations to accommodate a variety of doorway dimensions and/or wall configurations about the doorway. For example, if the wall includes a protruding feature, such as a door trim or border 107, then the spacer can be adjusted to provide a distance 105*a* to ensure clearance between the door and the door trim as the door moves relative to the doorway. If no such protruding feature exists on the wall, then the spacer can provide a distance 105*b* to ensure clearance between the door and the wall as the door moves relative to the doorway. The spacer can therefore facilitate variable spacing configurations to accommodate a variety of different door thicknesses and/or door trim sizes, for example. As discussed further hereinafter, in one aspect, a spacer can be adjustable while a door or panel is in use, such that the spacing configuration can be adjusted to move door or panel toward or away from a wall or support structure.

As used herein, the term "wall" can include any structure or feature coupled to, or otherwise associated with, a wall and/or a doorway, such as a structural component (e.g., a stud) or a protruding feature (e.g., a decorative molding or baseboard) that may adversely interfere with movement of the door relative to the doorway along the track. Thus, for example, the door trim 107 shown in the figures can be considered part of the wall 101.

Moreover, as used herein, a "support structure" can include a wall, a ceiling, a floor, or any other suitable support structure for a panel, a door, a window, a sign, a shutter, a chalkboard, a partition, etc.

The hardware system 100 can also include a door stop 150*a*, 150*b* to limit movement of the door 103 along the track 110 and, in one aspect, establish a range of motion for the door along the track. For example, the door stop can be coupleable to the track and can be configured to contact the hanger 120*a*, 120*b* and/or the door. As discussed further hereinafter, the door stop can be adjustable to vary a stop position of the door and/or vary the range of motion of the door.

In addition, the hardware system 100 can include a door guide 160 coupleable to the wall 101 to guide a bottom portion 108 of the door 103 as the door moves relative to the doorway 102. The door guide can prevent the bottom portion of the door from swinging or contacting the wall and/or door trim 107. In one aspect, the door guide can position the bottom portion of the door such that the door hangs substantially parallel to the wall. As discussed further hereinafter, the door guide can be adjustable to vary the position of the bottom portion of the door relative to the wall.

As described herein, the hardware system 100 can be adjustable or adaptable to a variety of door dimensions, such as width and thickness, and wall features, such as stud locations and door trim or borders. For example, a track 110 can have a length selected to correspond to a distance between wall studs, such that the adjustable spacers 130*a*, 130*d* can couple ends of the track to the wall studs. The adjustable spacers 130*b*, 130*c* can also be coupled to wall studs and support a middle section of the track between the adjustable spacers 130*a*, 130*d*. The length of the track, however, may not coincide with door 103 and doorway 102 width dimensions and desired stopping locations or limits for the travel of the door along the track. The door stops 150*a*, 150*b* can therefore provide some adjustability to account for such a mismatch in track length and mounting locations with the width of the door and/or doorway. Thus, standard track length sizes can be offered that can accommodate a range of door and doorway dimensions without the need for custom sizing of the track. In addition, door thickness and wall protrusions, such as a door trim, can lead to interference between the door and the wall protrusions if the track is inadequately spaced from the wall. The adjustable spacers and the door guides can therefore accommodate a range of door thicknesses and wall protrusions to facilitate successful operation of the door without customized spacer lengths offsetting the track from the wall and/or custom sized door guides.

Although the track 110 is shown coupled to the wall 101, it should be recognized that one or more wheels can be coupled to a wall, such as via adjustable spacers, and a track can be coupled to a hanger. In this embodiment, for example, a series of wheels can be aligned along the wall and the track can be coupled to a panel or door and can move with the door relative to the wall by riding on the wheels.

Additionally, in accordance with the present disclosure, adjustable spacers can be used to couple two or more tracks to one another in a "stacked" configuration, such as the track configurations typical of bypass doors or triple doors. Accordingly, the adjustable spacers can facilitate a desired or custom spacing between such tracks.

Figure 2:
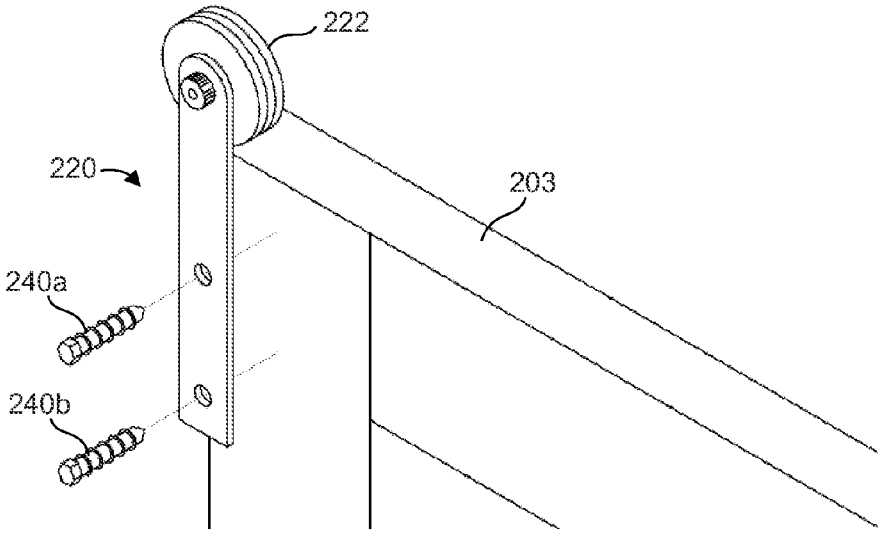
FIG. 2 is an exploded view of a hanger and a door, in accordance with an embodiment of the present disclosure.
Figure 3A:
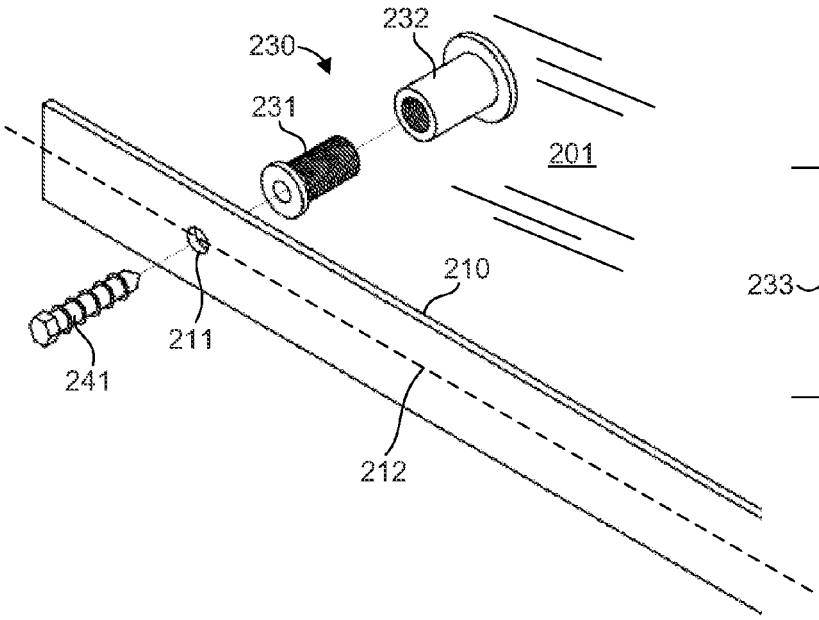
FIG. 3A is an exploded view of a track and an adjustable spacer, in accordance with an embodiment of the present disclosure.
Figure 3B:
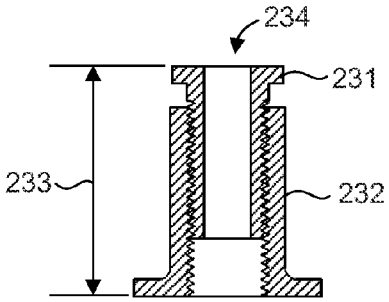
FIG. 3B is a cross-sectional view of the adjustable spacer of FIG. 3A.

In one aspect, the hardware system 100 can be provided as a kit to facilitate installing a door. For example, the system or kit can include instructions for installing a track, a wheel, a hanger, and spacer to a door and/or a wall. As shown in FIG. 2, for instance, a hanger 220 can be coupled to a door 203 with fasteners 240*a*, 240*b*, such as a screw, bolt, or other suitable fastener. In addition, FIGS. 3A and 3B illustrate an adjustable spacer 230 operable to couple a track 210 to a wall 201, with the adjustable spacer between the track and the wall. The spacer can comprise a first threaded portion 231 and a second threaded portion 232 threadedly coupled to one another, such that relative rotation of the first and second threaded portions is operable to change a length 233 of the spacer. The spacer can also comprise an opening 234 extending through the first threaded portion and the second threaded portion to accommodate a fastener 241. To install the track, the length of the spacer can be adjusted to provide a suitable distance or clearance from the wall. The fastener can then extend through a hole 211 in the track perpendicular to a longitudinal axis 212 of the track, and through the opening in the spacer in order to couple the track to the wall. It should be recognized that a spacer in accordance with the present disclosure can be any suitable size or configuration, such as partially threaded or fully threaded.

In some embodiments, an adjustable spacer can be length adjustable after installation, such as by rotating the first and second threaded portions 231, 232 relative to one another. This can be useful, for example, to move a door into a door jamb about the doorway in order to minimize or eliminate gaps between the door and doorway, which can also facilitate locking the door to the door jamb. For example, one of the threaded portions can be fixedly coupled to the wall 201, and the other threaded portion can be rotatably coupled to the hanger 220. The rotatable threaded portion can be rotated by a motor, such as an electric motor. The motor can be controlled by a switch, which can be activated by a user or activated automatically by a sensor sensing the presence of a person entering or leaving the doorway. In one aspect, an adjustable spacer can be length adjustable by a user applying a force to the door tending to move the door closer to the support surface or to move the door away from the support surface. In other words, the user can provide the force to cause rotation of the rotatable threaded portion instead of a motor. For example, the threaded portions can have threads of a sufficiently high pitch to facilitate relative rotation of the threaded portions, and the resultant change in length of the spacer, due to the force of a user pushing or pulling on the door.

Additionally, as illustrated in FIGS. 2 and 3A, the track can comprise a rail having a rectangular cross section and the wheel 222 can be configured to interface with that particular track configuration. As described further hereinafter, a track and wheel can have any suitable configuration, such as a wire track configuration or a box track configuration. In addition, a track, or any other structure described herein, can be constructed of any suitable material, such as steel or other metal, wood, plastic or other polymer such as acrylic materials, and in some cases, concrete.

Figure 4:
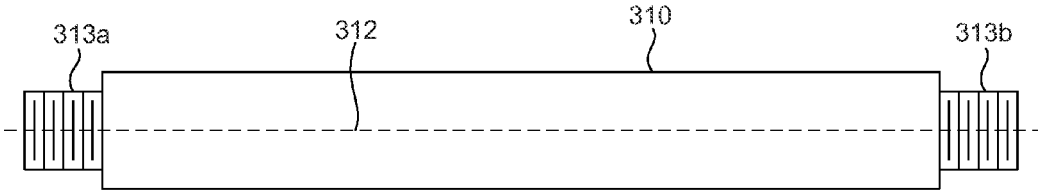
FIG. 4 illustrates a track having a circular cross-section, in accordance with an embodiment of the present disclosure.

FIG. 4 illustrates one embodiment of a track 310 comprising a tube having a circular cross section. The track can include coupling features 313*a*, 313*b*, such as a threaded fastener, at opposite ends to couple with a spacer. In one aspect, the track can be configured to couple with an adjustable spacer 330 shown in FIGS. 5A and 5B. For example, the coupling features can be configured to couple with a mating coupling feature 314, such as a threaded feature, in a head 337 of the adjustable spacer. The coupling feature of the adjustable spacer can be oriented in the head such that the spacer is coupled to the track with a fastener parallel to a longitudinal axis 312 of the track. In one aspect, the fastener can be integral with the track. In another aspect, the fastener can be a separate component that can couple the spacer and the track. Although the coupling features of the track and spacer are shown in the figures as mating threaded fasteners, the coupling features can be of any suitable configuration, such as a press fit or sliding fit that may or may not be secured with a separate fastener. In addition, although the track is shown having male threaded features and the spacer is shown having female threaded features, it should be recognized that the either of the track and the spacer can have male and/or female threaded features.

Figure 5A:
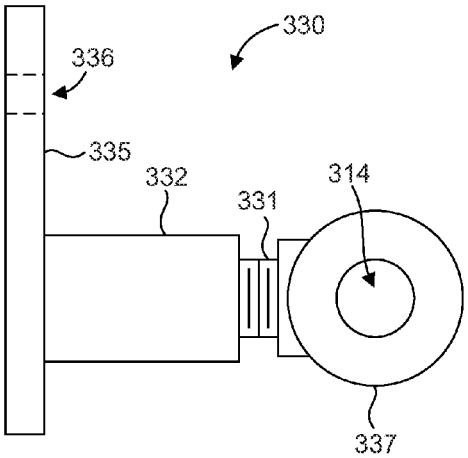
FIG. 5A is a side view of an adjustable spacer for the track of FIG. 4, in accordance with an embodiment of the present disclosure.
Figure 5B:
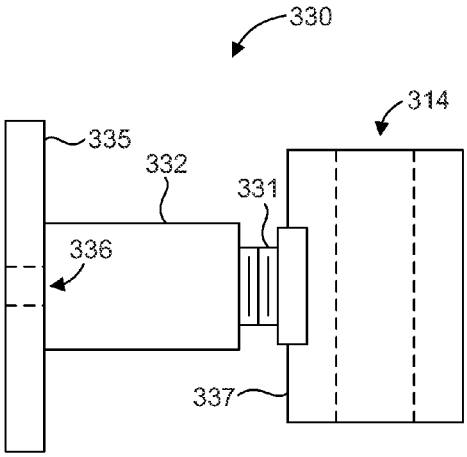
FIG. 5B is a top view of the adjustable spacer of FIG. 5A.

As with the adjustable spacer 230 shown in FIGS. 3A and 3B, a length of the adjustable spacer 330 of FIGS. 5A and 5B can be varied by rotating a first threaded portion 331 relative to a second threaded portion 332. In this case, however, the first threaded portion is coupled to a base 335, which includes a hole 336 for coupling the spacer to a wall with a fastener.

Figure 6A:
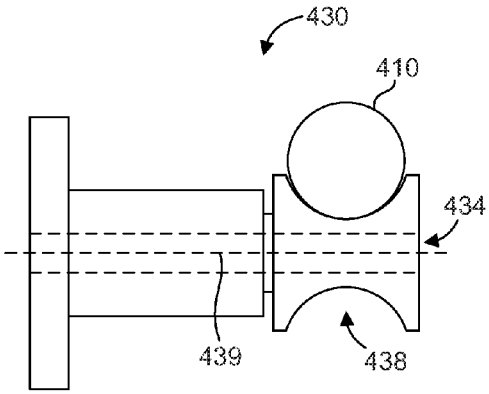
FIG. 6A is a side view of an adjustable spacer for a track having a circular cross-section, in accordance with another embodiment of the present disclosure.
Figure 6B:
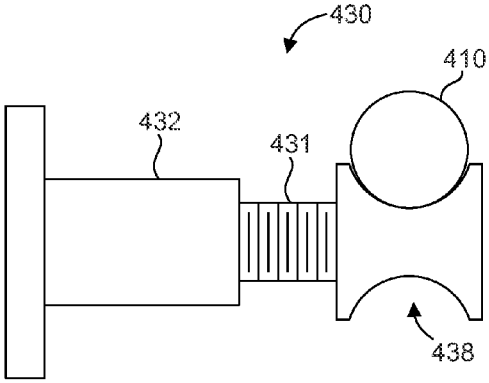
FIG. 6B is a side view of the adjustable spacer of FIG. 6A in an extended configuration.

FIGS. 6A and 6B illustrate an adjustable spacer 430 that is similar to the adjustable spacer shown in FIGS. 3A and 3B in that the adjustable spacer 430 includes an opening 434 through which a fastener can extend to couple the spacer to a wall. In this case, however, the spacer can be configured to support a track 410 having a circular cross-section resting on the spacer. For example, the spacer can comprise a concave cylindrical portion 438 configured to interface with and support the track. The concave cylindrical portion is symmetric about axis 439 such that relative rotation of the first and second threaded portions 431, 432 maintains a consistent interface surface for the track regardless of the rotational position of the concave cylindrical portion about the axis when the length is changed, such as in an extended configuration as shown in FIG. 6B.

It should be recognized that the spacers 330 and 430 of FIGS. 5A-6B can be used in combination, such as spacers 330 at ends of a track and spacers 430 in a middle portion of the track. It should also be recognized that multiple tracks can be assembled end-to-end via spacers 330.

Figure 7:
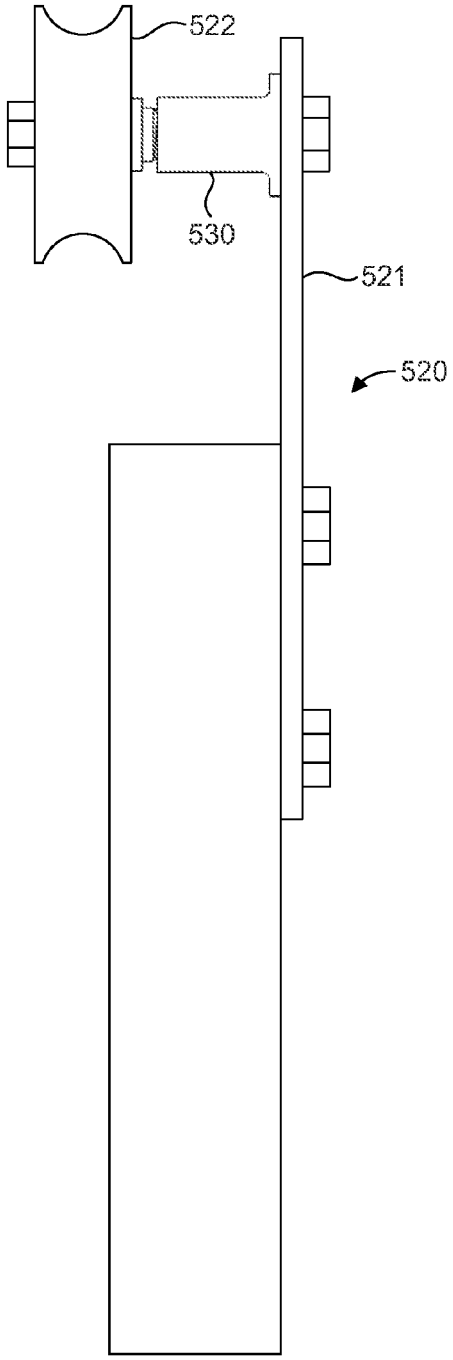
FIG. 7 is a side view of an adjustable spacer operable with a hanger, in accordance with an embodiment of the present disclosure.
Figure 8:
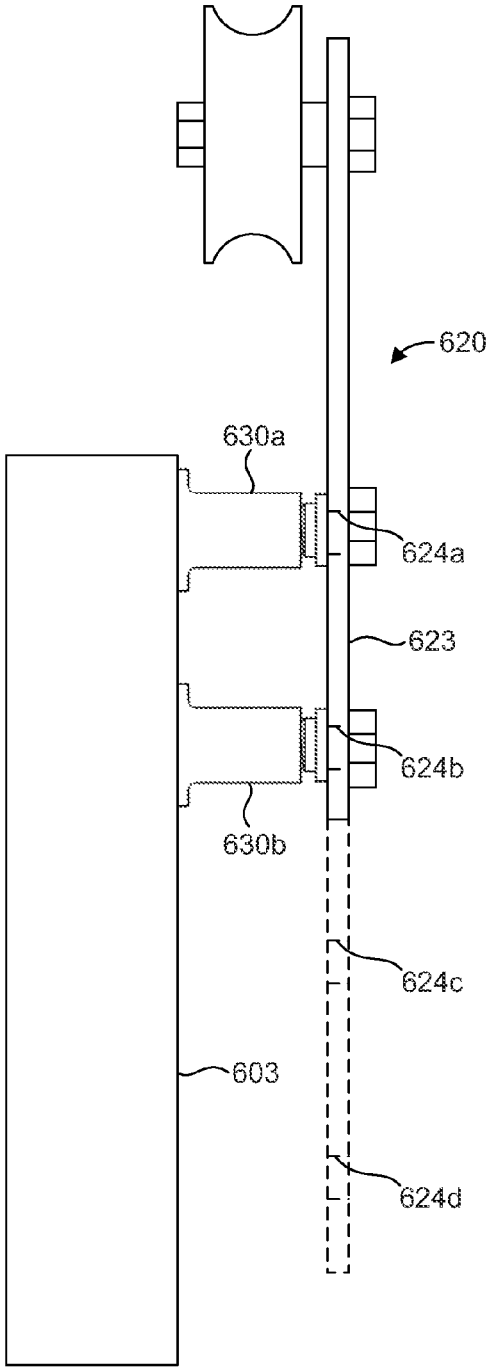
FIG. 8 is a side view of an adjustable spacer operable with a hanger, in accordance with another embodiment of the present disclosure.

FIGS. 7 and 8 illustrate embodiments of an adjustable spacer operable with a hanger to facilitate variable spacing configurations. For example, FIG. 7 illustrates an adjustable spacer 530 coupleable between a wheel 522 and an extension portion 521 of a hanger 520. FIG. 8 illustrates an adjustable spacer 630*a*, 630*b* coupleable between a door coupling portion 623 of a hanger 620, via holes 624*a*, 624*b*, respectively, and a door 603. As with some other embodiments of adjustable spacers disclosed herein, the adjustable spacers 530, 630*a*, 630*b* can be length adjustable via relative rotation of two threaded portions. In addition, the spacers can include openings extending through the threaded portions to facilitate coupling the spacers to the various components shown in the figures.

In one aspect, illustrated in FIG. 8, the door coupling portion 623 can be configured to include a plurality of holes 624*a-d* that are available for coupling with the door 603. The plurality of holes can provide options for coupling the hanger 620 with the door to achieve a desired position of the hanger with respect to the door, such as for a vertical adjustment, and can therefore provide another form of adjustment for a hardware system. As many holes as desired can be provided and/or utilized, as some may find it aesthetically pleasing to have holes in the hanger, with or without fasteners.

Figure 9:
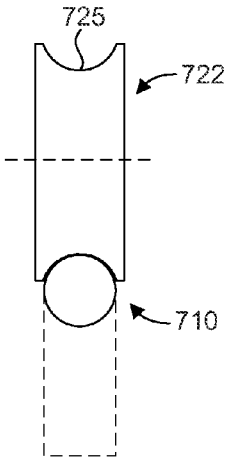
FIG. 9 is a side view of a wheel and track configuration, in accordance with an embodiment of the present disclosure.
Figure 10:
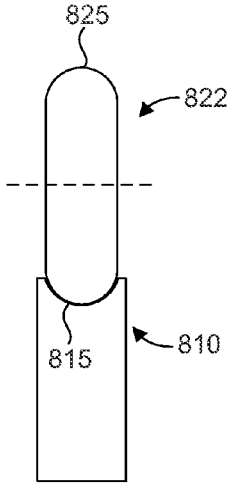
FIG. 10 is a side view of a wheel and track configuration, in accordance with another embodiment of the present disclosure.

FIGS. 9 and 10 illustrate examples of wheel and track configurations. For example, as shown in FIG. 9, a wheel 722 can have a concave cylindrical portion 725 configured to interface with a track 710. The track can have an entirely circular cross-section or only a circular cross-section for the portion including the interface surface. FIG. 10, on the other hand, illustrates a track 810 having a channel 815 to receive the wheel 822. In this case, the channel comprises a circular cross-section to interface with a circular interface surface 825 of the wheel. It should be recognized that any suitable track and/or wheel shape or configuration may be utilized in accordance with the present disclosure.

Figure 11A:
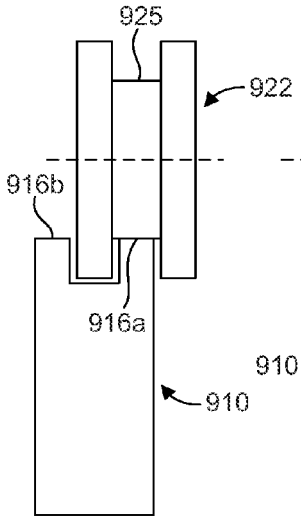
FIGS. 11A and 11B are side views of a wheel and track configuration in which an adjustable spacer is integral with the wheel and/or track, in accordance with an embodiment of the present disclosure.
Figure 11B:
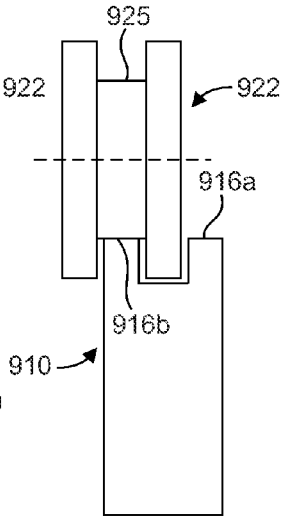
Figure 12A:
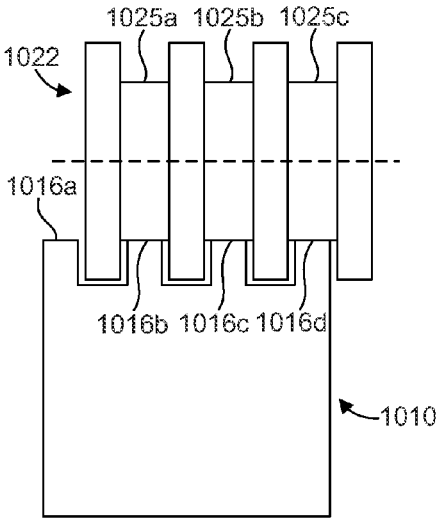
FIGS. 12A and 12B are side views of a wheel and track configuration in which an adjustable spacer is integral with the wheel and/or track, in accordance with another embodiment of the present disclosure.
Figure 12B:
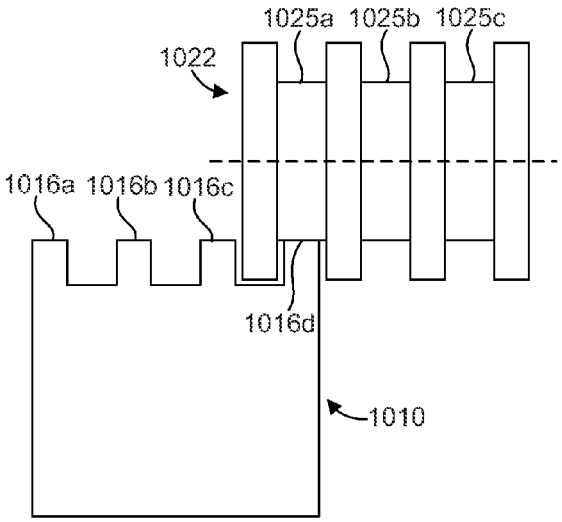

For example, FIGS. 11A and 12B illustrate track and wheel configurations in which an adjustable spacer is integrated with the wheel and/or track. For example, FIGS. 11A and 11B illustrate a track 910 having a plurality of wheel interface features 916*a*, 916*b*. The different wheel interface features can vary the spacing configuration to accommodate dimensions of different doors. For instance, a wheel 922 can include a track interface feature 925, such as a channel, that can interface with the wheel interface feature 916*a*, as shown in FIG. 11A, to provide one spacing configuration. The wheel can be repositioned with respect to the track such that the track interface feature interfaces with the wheel interface feature 916*b*, as shown in FIG. 11B, to provide another spacing configuration.

Furthermore, this concept can be extended to include any suitable number of wheel and track interface features. For example, as illustrated in FIGS. 12A and 12B, a wheel 1022 can include a plurality of track interface features 1025*a*, 1025*b*, 1025*c* and a track 1010 can include a plurality of wheel interface features 1016*a*, 1016*b*, 1016*c*, 1016*d*. The different track and/or wheel interface features can vary the spacing configuration to accommodate dimensions of different doors. For example, as shown in FIG. 12A, locating the wheel relative to the track such that track interface feature 1025*a* interfaces with wheel interface feature 1016*b* can provide one spacing configuration. As shown in FIG. 12B, locating the wheel relative to the track such that track interface feature 1025*a* interfaces with wheel interface feature 1016*d* can provide another spacing configuration. In general, a wider wheel and/or track and the greater the number of wheel and/or track interface features, the greater the range that can be adjusted and the greater the number of possible spacing locations. Thus, the track and wheel interface features can facilitate a variety of spacing configurations to accommodate a variety of door and wall configurations.

Figure 13:
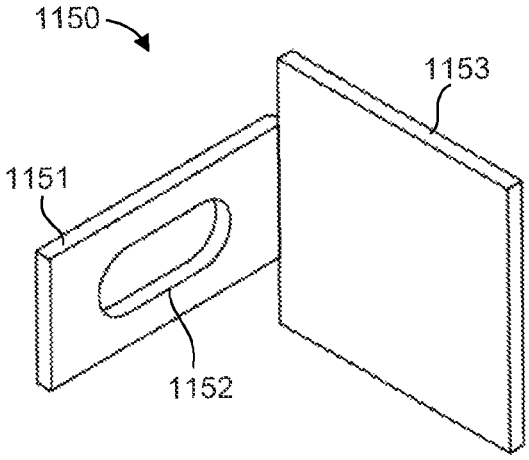
FIG. 13 is a perspective view of a stop, in accordance with an embodiment of the present disclosure.
Figure 14:
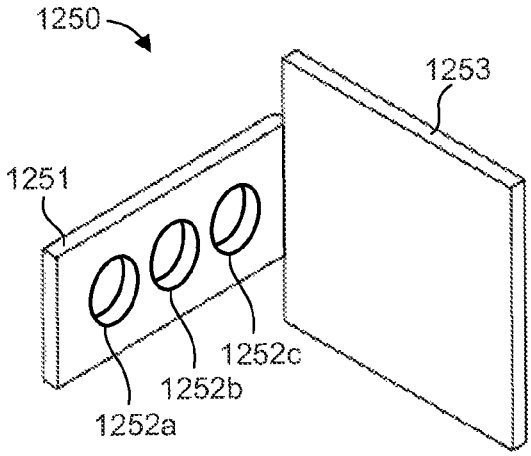
FIG. 14 is a perspective view of a stop, in accordance with another embodiment of the present disclosure.
Figure 15:
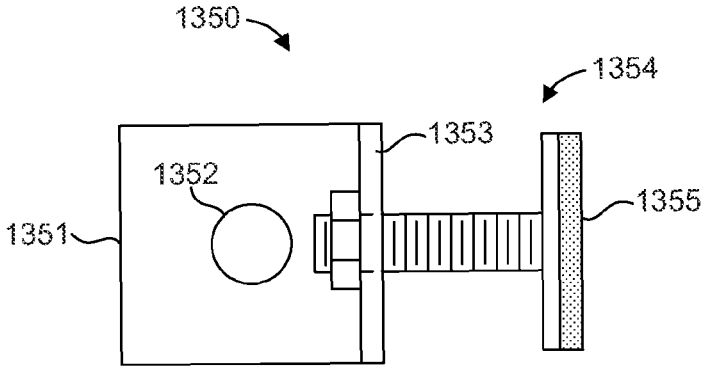
FIG. 15 is a side view of a stop, in accordance with yet another embodiment of the present disclosure.

With reference to FIGS. 13-15, several door stop embodiments are illustrated in accordance with the present disclosure. In one embodiment, FIG. 13 illustrates a door stop 1150 having a base portion 1151 configured to couple with a track via a coupling feature, such as an opening or slot 1152, and an extension arm 1153 extending from the base portion to interface with a hanger or door. The slot can facilitate movement or sliding of the base portion relative to the track about a fastener to position the extension arm in order to interfere with or limit movement of a door. The slot can facilitate infinitely variable adjustments to the position of the extension arm within a range of movement constrained by the slot's interface with the fastener. The fastener can fix the door stop relative to a track. Thus, the door stop can be configured to provide a variable stop location for a door relative to the track.

In another embodiment, FIG. 14 illustrates a door stop 1250 having a base portion 1251 configured to couple with a track via a plurality of coupling features, such as a plurality of openings or holes 1252*a*, 1252*b*, 1252*c*, to provide a variable stop location. The plurality of holes can facilitate discrete adjustments to the position of an extension arm 1253 depending on which hole receives a fastener.

In yet another embodiment, FIG. 15 illustrates a door stop 1350 having a base portion 1351 configured to couple with a track via a single coupling feature, such as a hole 1352. In this case, a variable stop location is provided by an extension portion 1354 threadedly coupled to the base portion. For example, the extension portion can be threadedly coupled to the base portion via a threaded interface with an extension arm 1353, and rotation of the extension portion can vary a position of a pad 1355 relative to the extension arm and base portion. In one aspect, the pad can include a material configured to cushion an impact with the door or hanger, such as a rubber, polymer, felt, foam, or any other suitable material. It should be recognized that such a material can be included with extension arms 1153, 1253 as desired to cushion an impact with the door or hanger.

Figure 16:
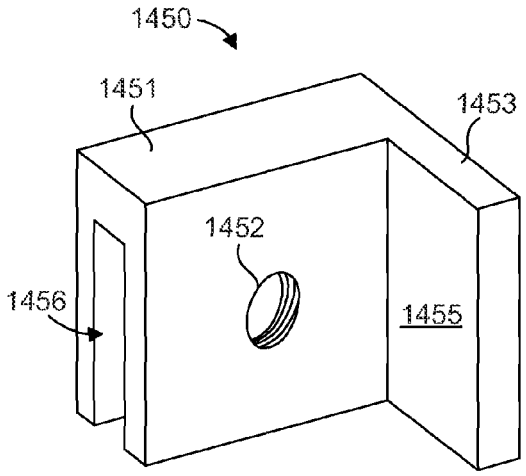
FIG. 16 is a perspective view of a stop having a channel configuration, in accordance with an embodiment of the present disclosure.

FIGS. 16-19 illustrate several other embodiments of door stops in accordance with the present disclosure. In one embodiment, FIG. 16 illustrates a door stop 1450 having a channel 1456 extending through a base portion 1451 to receive and slidably interface with a track. A set screw or other fastener can be threaded into a hole 1452 to bear against the track in order to fix the door stop relative to the track. This embodiment can accommodate a single set screw. Thus, the door stop can be slidable relative to the track to provide a variable stop location. Also shown is an extension arm 1453 extending from an end of the base portion to interface with a hanger or door. The extension arm includes a flat or planar surface 1455 that can interface with the hanger or door. In this case, the base portion and the extension arm are of a generally rectangular cuboid configuration, although as described further hereinafter, the base portion and the extension arm can be any suitable configuration.

Figure 17:
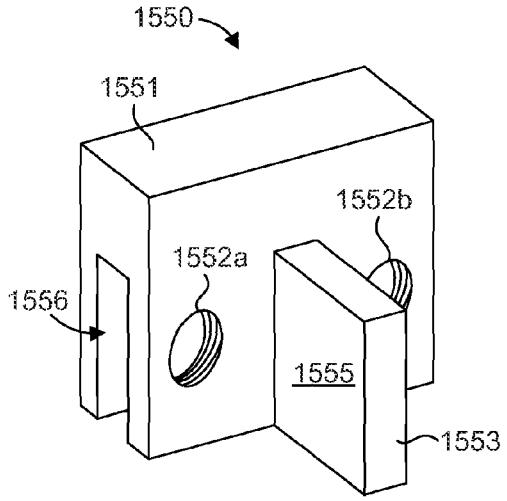
FIG. 17 is a perspective view of a stop having a channel configuration, in accordance with another embodiment of the present disclosure.

In another embodiment, FIG. 17 illustrates a door stop 1550 having a channel 1556 extending through a base portion 1551 to receive and slidably interface with a track. In this case, two set screws or other fasteners can be threaded into holes 1552*a*, 1552*b* to bear against the track in order to fix the door stop relative to the track. Thus, this embodiment can accommodate a plurality set screws, as desired. Also shown is an extension arm 1553 extending from a middle of the base portion to interface with a hanger or door. The extension arm includes a flat or planar surface 1555 that can interface with the hanger or door.

Figure 18:
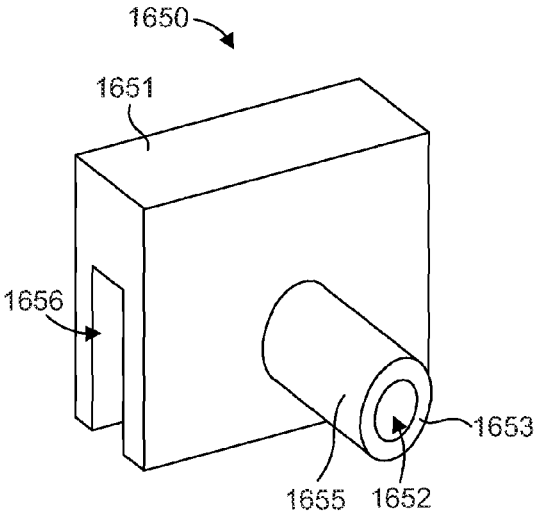
FIG. 18 is a perspective view of a stop having a channel configuration, in accordance with yet another embodiment of the present disclosure.

In yet another embodiment, FIG. 18 illustrates a door stop 1650 having a channel 1656 extending through a base portion 1651 to receive and slidably interface with a track. An extension arm 1653 can extend from a center of the base portion to interface with a hanger or door. The extension arm includes a cylindrical surface 1655 that can interface with the hanger or door. A set screw or other fastener can be threaded into a hole 1652 in the center of the extension arm to bear against the track in order to fix the door stop relative to the track. This configuration can conceal the set screw and integrate the function of the extension arm with the function of the set screw.

Figure 19:
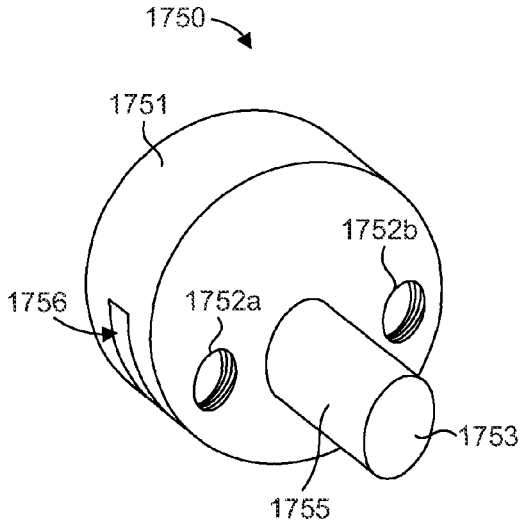
FIG. 19 is a perspective view of a stop having a channel configuration, in accordance with still another embodiment of the present disclosure.

In still another embodiment, FIG. 19 illustrates a door stop 1750 having a channel 1756 extending through a generally cylindrical base portion 1751 to receive and slidably interface with a track. In this case, two set screws or other fasteners can be threaded into holes 1752*a*, 1752*b* to bear against the track in order to fix the door stop relative to the track. Thus, this embodiment can also accommodate a plurality set screws, as desired. Also shown is an extension arm 1753 extending from a center of the base portion to interface with a hanger or door. The extension arm includes a cylindrical surface 1755 that can interface with the hanger or door.

Figure 20:
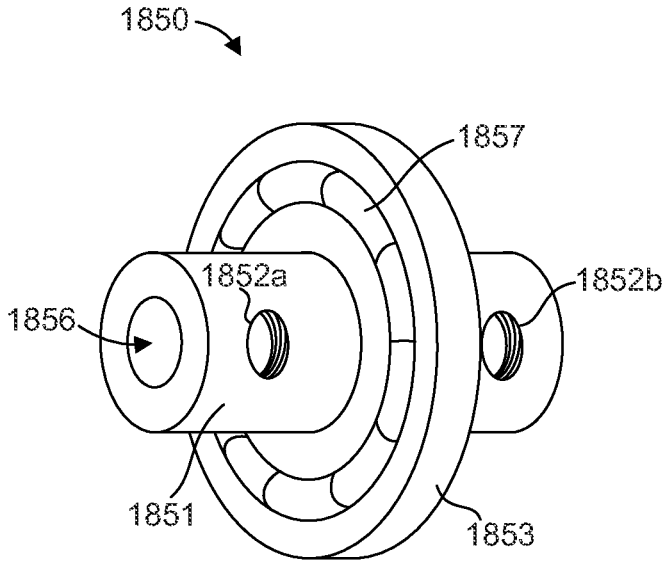
FIG. 20 is a perspective view of a stop having an opening to receive a track, in accordance with an embodiment of the present disclosure.
Figure 21:
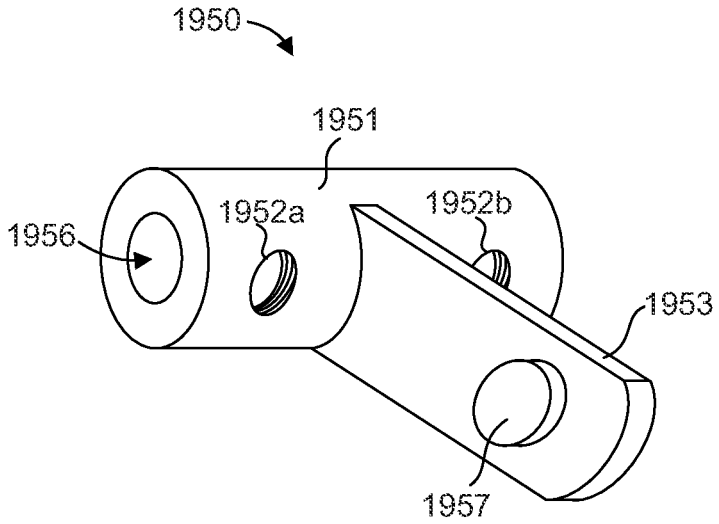
FIG. 21 is a perspective view of a stop having an opening to receive a track, in accordance with another embodiment of the present disclosure.

FIGS. 20 and 21 illustrate additional embodiments of door stops in accordance with the present disclosure. In one embodiment, FIG. 20 illustrates a door stop 1850 having an opening 1856, such as a cylindrical hole, extending through a generally cylindrical base portion 1851 to receive and slidably interface with a track having a circular cross-section. In this case, two set screws or other fasteners can be threaded into holes 1852*a*, 1852*b* to bear against the track in order to fix the door stop relative to the track. Also shown is an extension arm 1853 extending from a center of the base portion to interface with a hanger or door. The extension arm comprises a generally cylindrical configuration that is substantially coaxial with the cylindrical configuration of the base. This configuration can facilitate effectiveness of the door stop in any orientation about the track. In addition, the extension arm can include a material configured to cushion an impact with the hanger or door, such as a rubber, polymer, felt, foam, or any other suitable material. In this case, an O-ring 1857 is coupled to the extension arm to provide a cushion for impact with the hanger or door.

In another embodiment, FIG. 21 illustrates a door stop 1950 having an opening 1956, such as a cylindrical hole, extending through a generally cylindrical base portion 1951 to receive and slidably interface with a track having a circular cross-section. Two set screws or other fasteners can be threaded into holes 1952*a*, 1952*b* to bear against the track in order to fix the door stop relative to the track. Also shown is an extension arm 1953 extending from a center of the base portion to interface with a hanger or door. The extension arm can be positioned and oriented to contact the hanger or door at a suitable location and fixed in place relative to the track with the set screws. In addition, the extension arm can include a material configured to cushion an impact with the hanger or door, such as a rubber, polymer, felt, foam, or any other suitable material. In this case, a pad 1957 is coupled to the extension arm to provide a cushion for impact with the hanger or door.

It light of the above, it should be recognized that a base portion and an extension arm of a door stop can comprise any suitable shape or combination of shapes. Additionally, it should be recognized that any number of set screws can be used to fix the location of the door stop relative to the track. Moreover, the channel configuration or opening can be configured to interface with and receive a track of any suitable size, shape, or configuration.

Figure 22:
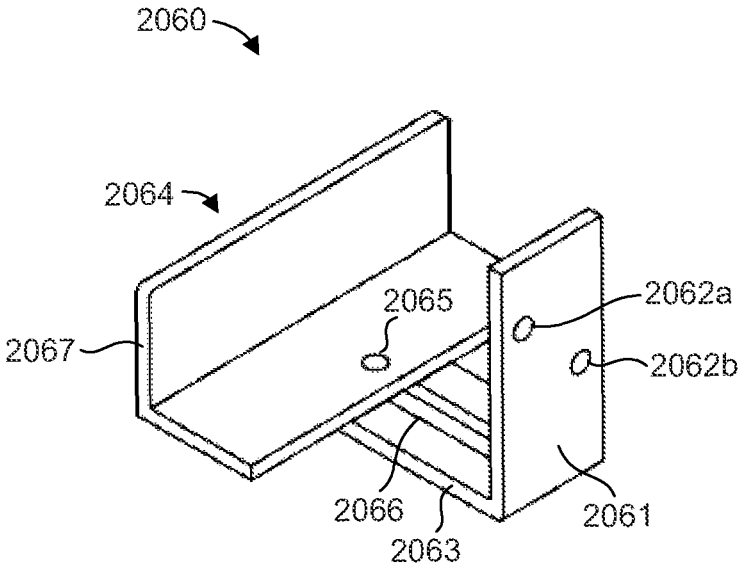
FIG. 22 is a perspective view of a guide, in accordance with an embodiment of the present disclosure.
Figure 23:
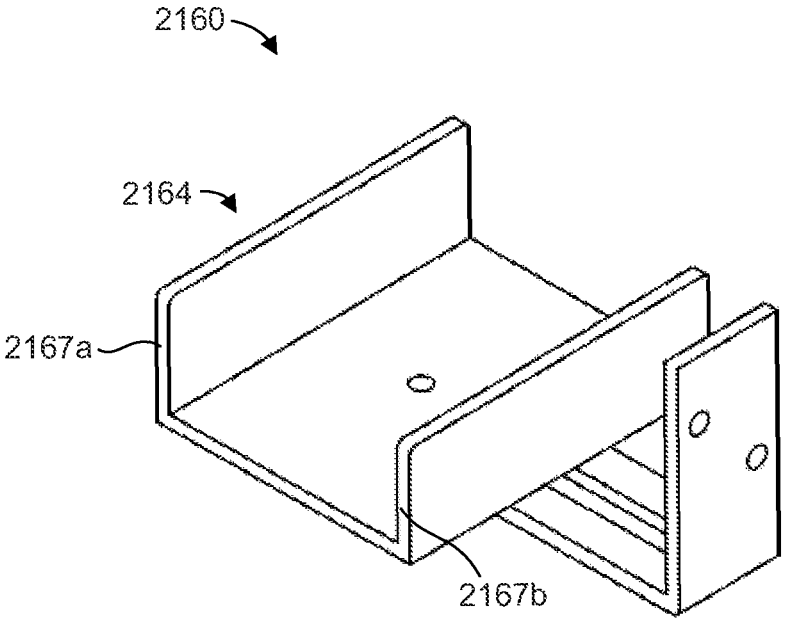
FIG. 23 is a perspective view of a guide, in accordance with another embodiment of the present disclosure.

FIGS. 22 and 23 illustrate embodiments of door guides in accordance with the present disclosure. For example, FIG. 22 illustrates a door guide 2060 that can be coupleable to a wall to guide a bottom portion of the door as the door moves relative to the doorway. The door guide can have a mounting portion 2061 to interface with a wall, and can include one or more holes 2062*a*, 2062*b* to receive fasteners for coupling the door guide to the wall. The door guide can also include a base portion 2063 and a door interface portion 2064 that can be slidable relative to the base portion to provide a variable guide location for the door. The door interface portion can include a vertical extension 2067 to interface with a channel in the bottom portion of the door in order to guide the door. In addition, a fastener 2065 can extend through a slot 2066 in the base portion. The slot can facilitate movement on the door interface portion relative to the base portion and the fastener can fix the door interface portion relative to the base portion at a desired location. The adjustability of the door guide provides the ability to mount the door guide to a wall, which can be preferable to mounting a door guide to a floor due to the sometimes hard and/or expensive materials used in floors.

FIG. 23 illustrates a door guide 2160 that is similar in many respects to the door guide 2060 of FIG. 22. The door guide 2160, however, includes a door interface portion 2164 that has a channel configuration to interface with and receive the bottom portion of a door, which can be useful for a door that does not have a channel in a bottom portion of the door. For example, the door interface portion can include two vertical extensions 2167*a*, 2167*b* configured to form a channel to receive a bottom of a door. The vertical extensions of FIGS. 22 and 23 are two examples of suitable configurations for interfacing with and guiding a bottom portion of a door. It should be recognized that a door interface portion can be of any suitable configuration to interface with and guide a bottom portion of a door.

Figure 24:
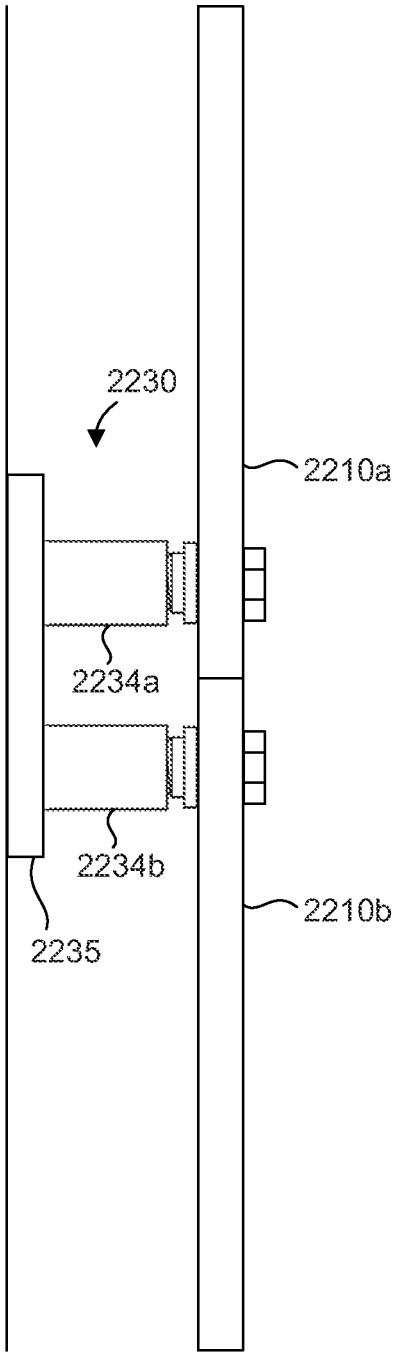
FIG. 24 is a side view of a spacer for splicing track segments, in accordance with an embodiment of the present disclosure.

FIG. 24 illustrates another embodiment of a spacer 2230 in accordance with the present disclosure. In this embodiment, the spacer can include two or more spacing features 2234*a*, 2234*b*, which are each operable to change length, coupled to a common base 2235. One spacing feature can be coupled to an end of track 2210*a* and the other can be coupled to and end of track 2210*b* such that the tracks abut one another. Thus, in one aspect, one or more such spacers can function to splice or couple two or more track segments in order to provide a desired overall track length from the track segments.

Furthermore, in accordance with one embodiment of the present invention, a method for facilitating installation of a door is disclosed. The method can comprise providing a track. The method can also comprise providing a wheel configured to interface with the track. The method can further comprise providing a hanger including an extension portion, and a panel coupling portion to couple with a panel, wherein the track or the wheel is coupleable to a support structure and the other of the track or the wheel is coupleable to the extension portion such that the panel is movable relative to the support structure. The method can still further comprise providing an adjustable spacer operable with at least one of the track, the wheel, and the hanger to provide a distance between the panel and the support structure as the panel moves relative to the support structure. Additionally, the method can comprise facilitating variable spacing configurations of the spacer to accommodate a variety of panel dimensions or support structure configurations. It is noted that no specific order is required in this method, though generally in one embodiment, these method steps can be carried out sequentially.

In one aspect of the method, a length of the spacer can be adjustable to vary the spacing configuration. In a specific aspect, the spacer can comprise a first threaded portion and a second threaded portion threadedly coupled to one another, such that relative rotation of the first and second threaded portions is operable to change the length of the spacer. In another aspect, the method can further comprise providing a stop coupleable to the track, wherein the stop is configured to provide a variable stop location for the panel relative to the track. In yet another aspect, the method can further comprise providing a guide coupleable to the support structure to guide a bottom portion of the panel as the panel moves relative to the support structure, wherein the guide is configured to provide a variable guide location for the bottom portion of the panel relative to the support structure.

In accordance with another embodiment of the present invention, a method of hanging a panel is disclosed. The method can comprise obtaining i) a track; ii) a wheel configured to interface with the track; iii) a hanger including an extension portion, and a panel coupling portion to couple with a panel, wherein the track or the wheel is coupleable to a support structure and the other of the track or the wheel is coupleable to the extension portion such that the panel is movable relative to the support structure; and iv) an adjustable spacer operable with at least one of the track, the wheel, and the hanger to provide a distance between the panel and the support structure as the panel moves relative to the support structure. The method can also comprise attaching the panel to the hanger. The method can further comprise affixing the track or the wheel to the support structure with the spacer positioned therebetween. Additionally, the method can comprise adjusting the spacer to provide a distance between the support structure and the panel so that the panel can freely move along the support structure when the wheel moves relative to the track. As with other methods disclosed herein, no specific order is required in this method, though generally in one embodiment, these method steps can be carried out sequentially.

In one aspect of the method, the step of affixing can be prior to the step of adjusting. In another aspect of the method, the step of affixing can be after the step of adjusting.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A panel hardware system, comprising:

a track;

a wheel configured to interface with the track;

a hanger including an extension portion, and a panel coupling portion to couple with a panel, wherein the track or the wheel is coupleable to a support structure and the other of the track or the wheel is coupleable to the extension portion such that the panel is movable relative to the support structure; and an adjustable spacer operable with at least one of the track, the wheel, and the hanger to provide a distance between the panel and the support structure as the panel moves relative to the support structure, wherein the spacer facilitates variable spacing configurations to accommodate a variety of panel dimensions or support structure configurations.

2. The panel hardware system of claim 1, wherein a length of the spacer is adjustable to vary the spacing configuration.

3. The panel hardware system of claim 2, wherein the spacer comprises a first threaded portion and a second threaded portion threadedly coupled to one another, such that relative rotation of the first and second threaded portions is operable to change the length of the spacer.

4. The panel hardware system of claim 3, wherein the spacer comprises an opening extending through the first threaded portion and the second threaded portion to accommodate a fastener.

5. The panel hardware system of claim 1, wherein the spacer is operable to couple the track to the support structure.

6. The panel hardware system of claim 5, wherein the spacer is coupleable between the track and the support structure.

7. The panel hardware system of claim 1, wherein the spacer is coupleable between the wheel and the extension portion of the hanger.

8. The panel hardware system of claim 1, wherein the spacer is coupleable between the panel coupling portion of the hanger and the panel.

9. The panel hardware system of claim 1, wherein the track comprises a rail having a rectangular cross section.

10. The panel hardware system of claim 1, wherein the track comprises a tube having a circular cross section.

11. The panel hardware system of claim 10, wherein the spacer comprises a concave cylindrical portion configured to interface with and support the track.

12. The panel hardware system of claim 10, wherein the wheel comprises a concave cylindrical portion configured to interface with the track.

13. The panel hardware system of claim 1, wherein the track comprises a channel to receive the wheel.

14. The panel hardware system of claim 1, wherein the spacer is integral with the wheel and comprises a plurality of track interface features, wherein different track interface features vary the spacing configuration to accommodate dimensions of different panels.

15. The panel hardware system of claim 1, wherein the spacer is integral with the track and comprises a plurality of wheel interface features, wherein different wheel interface features vary the spacing configuration to accommodate dimensions of different panels.

16. The panel hardware system of claim 1, further comprising a stop coupleable to the track.

17. The panel hardware system of claim 16, wherein the stop is configured to provide a variable stop location for the panel relative to the track.

18. The panel hardware system of claim 17, wherein the stop comprises a plurality of coupling features for coupling with the track to provide the variable stop location.

19. The panel hardware system of claim 17, wherein the stop comprises a base portion and an extension portion threadedly coupled to the base portion to provide the variable stop location.

20. The panel hardware system of claim 17, wherein the stop is slidable relative to the track to provide the variable stop location.

21. The panel hardware system of claim 20, wherein the stop comprises a fastener to fix the stop relative to the track.

22. The panel hardware system of claim 20, wherein the stop comprises a set screw to fix the stop relative to the track.

23. The panel hardware system of claim 20, wherein the stop comprises a channel configuration to receive and slidably interface with the track.

24. The panel hardware system of claim 20, wherein the stop comprises an opening extending therethrough to receive and slidably interface with the track.

25. The panel hardware system of claim 1, wherein the spacer is coupled to the track with a fastener perpendicular to a longitudinal axis of the track.

26. The panel hardware system of claim 1, wherein the spacer is coupled to the track with a fastener parallel to a longitudinal axis of the track.

27. The panel hardware system of claim 1, further comprising a guide coupleable to the support structure to guide a bottom portion of the panel as the panel moves relative to the support structure.

28. The panel hardware system of claim 27, wherein the guide is configured to provide a variable guide location for the bottom portion of the panel relative to the support structure.

29. The panel hardware system of claim 28, wherein the guide comprises a base portion, and a panel interface portion slidable relative to the base portion to provide the variable guide location.

30. The panel hardware system of claim 29, wherein the guide comprises a fastener to fix the panel interface portion relative to the base portion.

31. The panel hardware system of claim 29, wherein the panel interface portion comprises a channel configuration to interface with and receive the bottom portion of the panel.

32. The panel hardware system of claim 29, wherein the panel interface portion comprises a vertical extension to interface with a channel in the bottom portion of the panel.

33. The panel hardware system of claim 1, further comprising instructions for installing the track, the wheel, the hanger, and the spacer to the panel and the support structure.

34. The panel hardware system of claim 1, further comprising the panel.

35. The panel hardware system of claim 34, wherein the panel comprises a door.

36. The panel hardware system of claim 34, wherein the panel comprises a door, a window, a sign, a shutter, a chalkboard, a partition, or combinations thereof.

37. A method for facilitating installation of a panel, comprising:

providing a track;

providing a wheel configured to interface with the track;

providing a hanger including an extension portion, and a panel coupling portion to couple with a panel, wherein the track or the wheel is coupleable to a support structure and the other of the track or the wheel is coupleable to the extension portion such that the panel is movable relative to the support structure;

providing an adjustable spacer operable with at least one of the track, the wheel, and the hanger to provide a distance between the panel and the support structure as the panel moves relative to the support structure; and facilitating variable spacing configurations of the spacer to accommodate a variety of panel dimensions or support structure configurations.

38. The method of claim 37, wherein a length of the spacer is adjustable to vary the spacing configuration.

39. The method of claim 38, wherein the spacer comprises a first threaded portion and a second threaded portion threadedly coupled to one another, such that relative rotation of the first and second threaded portions is operable to change the length of the spacer.

40. The method of claim 37, further comprising providing a stop coupleable to the track, wherein the stop is configured to provide a variable stop location for the panel relative to the track.

41. The method of claim 37, further comprising providing a guide coupleable to the support structure to guide a bottom portion of the panel as the panel moves relative to the support structure, wherein the guide is configured to provide a variable guide location for the bottom portion of the panel relative to the support structure.

42. A method of hanging a panel, comprising:

obtaining i) a track; ii) a wheel configured to interface with the track; iii) a hanger including an extension portion, and a panel coupling portion to couple with a panel, wherein the track or the wheel is coupleable to a support structure and the other of the track or the wheel is coupleable to the extension portion such that the panel is movable relative to the support structure; and iv) an adjustable spacer operable with at least one of the track, the wheel, and the hanger to provide a distance between the panel and the support structure as the panel moves relative to the support structure;

attaching the panel to the hanger;

affixing the track or the wheel to the support structure with the spacer positioned therebetween; and adjusting the spacer to provide a distance between the support structure and the panel so that the panel can freely move along the support structure when the wheel moves relative to the track.

43. The method of claim 42, wherein the step of affixing is prior to the step of adjusting.

44. The method of claim 42, wherein the step of affixing is after the step of adjusting.

* * * * *